United States Patent [19]

Muheim et al.

[11] Patent Number: 5,046,943

[45] Date of Patent: Sep. 10, 1991

[54] AIR THROTTLE CONTROL FOR A TWO-STAGE BLOWER BURNER

[75] Inventors: Rudolf Muheim, Oberwil; Robert Von Euw, Luzern, both of Switzerland

[73] Assignee: LGZ Landis & Gyr Zug AG, Zug, Switzerland

[21] Appl. No.: 189,424

[22] Filed: May 2, 1988

[30] Foreign Application Priority Data

May 6, 1987 [CH] Switzerland ..... 01733/87

[51] Int. Cl.[5] ..... F23N 1/02; F23N 3/08

[52] U.S. Cl. ..... 431/62; 137/624.18; 251/129.04; 251/129.12; 431/63; 431/75

[58] Field of Search ..... 251/129.01, 129.04, 251/129.12; 431/27, 62, 63, 75, 18, 73; 137/624.13, 624.18, 487.5

[56] References Cited

U.S. PATENT DOCUMENTS

| | | | |
|---|---|---|---|
| 2,612,319 | 9/1952 | Wadenstein | 236/15 C |
| 3,358,735 | 12/1967 | Luft | 431/62 |
| 3,393,868 | 7/1968 | Greim, Jr. | 431/62 |
| 3,732,057 | 5/1973 | Lipper et al. | 431/62 |
| 4,425,930 | 1/1984 | Kruto | 431/62 |
| 4,482,312 | 11/1984 | Cade | 431/63 |
| 4,747,771 | 5/1988 | Goodfellow et al. | 431/62 |
| 4,978,291 | 12/1990 | Nakai | 431/12 |

FOREIGN PATENT DOCUMENTS

| | | |
|---|---|---|
| 1453493 | 9/1966 | France . |
| 2150320 | 1/1987 | United Kingdom . |

*Primary Examiner*—George L. Walton

*Attorney, Agent, or Firm*—Marmorek, Guttman & Rubenstein

[57] ABSTRACT

A blower burner capable of operating in two burner steps comprises a drive for an air throttle capable of running in a first direction from closed to open and in a second direction from open to closed, an auxiliary switch connected to the drive of the air throttle, a latch-free no-voltage relay, and a single-wire relay. The auxiliary switch is activated by the drive when the drive is running towards open position before the air throttle reaches the set position for the first burner step. The no-voltage relay is excited upon activation by the auxiliary switch. The single-wire relay operates under the control of the latch-free, no-voltage relay to cause the drive to switch over to drive towards the closed position after a built-in delay when the no-voltage relay has been excited.

2 Claims, 2 Drawing Sheets

AIR THROTTLE CONTROL FOR A TWO-STAGE BLOWER BURNER

FIELD OF THE INVENTION

This invention relates to an air throttle control for a two-stage blower burner.

BACKGROUND OF THE INVENTION

GB 2 150 320 B describes an air throttle control for a blower burner capable of being operated in two stages and capable of being assembled in a relatively compact form.

The air throttle control described therein is still too large for certain pre-constructed small drives of air throttles. It is not possible, for instance, to install into some of the existing small drives the relay which is used in this prior art air throttle control. The prior art relay includes a latch. The space required by such a relay is about double and its price is considerably higher than a relay without a latch.

It is the object of the instant invention to modify the circuits for an air throttle control of the kind described in GB 2 150 320 B in such manner that less space will be required, making it possible to incorporate the air throttle control into such small drives.

SUMMARY OF THE INVENTION

In accordance with the present invention, an air throttle control for a blower burner capable of operating in two burner steps is provided. The inventive blower burner comprises a drive for an air throttle capable of running in a first direction from closed to open and in a second direction from open to closed, an auxiliary switch connected to the drive of the air throttle, a latch-free, no-voltage relay, and a single-wire relay. The auxiliary switch is activated by the drive when the drive is running towards open position before the air throttle reaches the set position for the first burner step. The no-voltage relay is excited upon activation of the auxiliary switch. The single-wire relay operates under the control of the latch-free, no-voltage relay to cause the drive to switch over to drive towards the closed position after a built-in delay when the no-voltage relay has been excited.

BRIEF DESCRIPTION OF THE INVENTION

Figure 1:
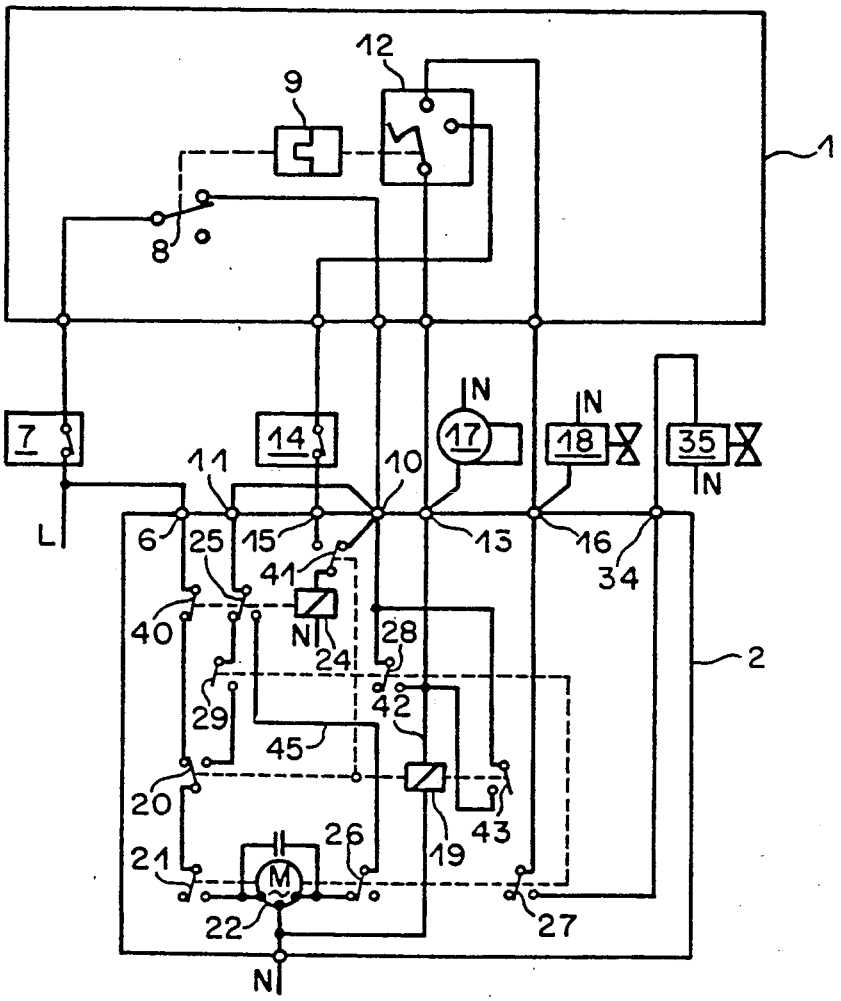
FIG. 1 shows a circuit diagram of an air throttle control according to the existing state of the art (e.g., FIG. 7 of GB 2 150 320 B)

Referring to FIG. 1, a two-stage blower burner includes a burner controller 1 (i.e., an automatic firing device) and an air throttle control 2 (i.e., air flap drive means) as well as a number of auxiliary devices. A phase conductor L feeds the air throttle control 2 at a terminal 6 and feeds the burner controller 1 via a first regulator 7. When a safety contact 8 of a thermal switch 9 is closed, the voltage of the phase conductor L is also applied to a main input terminal 10 and to an auxiliary terminal 11 of the air throttle control 2. Thermal switch 9 activates a time switch 12 which connects in one state an output terminal 13 by way of a second regulator 14 to a regulator terminal 15, and which connects in a second state the terminal 13 to a terminal 16. A blower 17 is connected to the output terminal 13 and the terminal 16 leads to a first fuel valve 18 which is activated during the first stage of the blower burner.

Burner controller 1 includes a flame monitor (not shown). When no flame is present, the flame monitor opens the safety contact 8. The air throttle control 2 is then without voltage with the exception of the terminal 6.

When there is no voltage at main input terminal 10, a no-voltage relay 19 in air throttle control 12 activates a "drive towards closed position" changeover 20 which is connected by its normally closed contact via a switch 40 to the terminal 6. A contact of the switch 20 is connected to a "drive towards closed position" circuit breaker 29. The output of the "drive towards closed position" switch 20 is connected to a "closed position" limit switch 21 which causes drive 22, in this case a motor, connected to an air throttle (not shown) to run towards "closed position" until limit switch 21 interrupts the circuit and shuts the motor off when the air throttle is completely closed.

Drive 22 runs towards "open position" when an "open position" limit switch 26 is closed and is connected to a voltage. The limit switch 26 opens and shuts drive 22 off when the air throttle is completely open. Drive 22 is connected directly with the neutral conductor N. A "drive towards open position" conductor 45 runs from the "open position" limit switch 26 to a "drive direction" changeover switch 25 which is activated by a single wire relay 24. The switch 25 is connected to auxiliary terminal 11 while its normally closed contact is connected to the "drive towards closed position" circuit breaker 29 and its working contact is connected to the "drive towards open position" conductor 45. The single-wire relay 24 furthermore activates the switch 40 which is closed when the single-wire relay 24 is not excited.

The single-wire relay 24 is connected to the "single-wire relay" changeover switch 41 which is controlled by the no-voltage relay 19. The normally closed contact of changeover switch 41 is connected to the main terminal 10 and the working contact of changeover switch 41 is connected to the regulator terminal 15.

Figure 2:
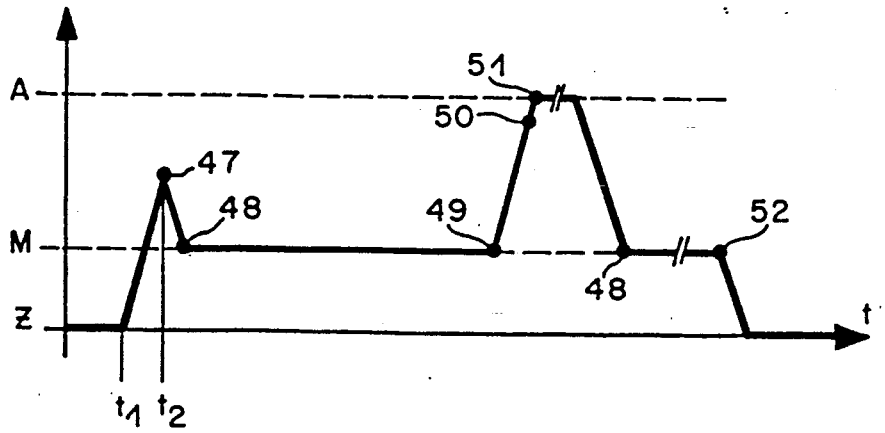
FIG. 2 shows a graph associated with FIG. 1.

An auxiliary switch 28 is furthermore provided between the main input terminal 10 and the output terminal 13, said auxiliary switch 28 being activated when the air throttle drive 22 reaches point 47 shown in FIG. 2. Point 47 is located between the position for operation of the first burner step M (FIG. 2) and the position for the operation of the second burner step A (FIG. 2). Parallel to said auxiliary switch 28 is a latch 43 of the no-voltage relay 19. This latch 43 is required here since, after point 47 is reached, the air throttle drive 22 runs towards "closed position" (as shown by the drop in FIG. 2 after point 47). As a result, the auxiliary switch 28 opens again. However, the no-voltage relay 19 remains excited due to the operation of latch 43.

When the air throttle drive 22 reaches point 50 (FIG. 2), the "second burner valve" switch 27 is activated and opens the burner valve 35 for the second burner step.

The graph of FIG. 2 shows the air throttle position as a function of time. In FIG. 2, Z denotes a "totally closed" position while M and A have the above-indicated meanings.

When the air throttle control 2 is switched on, a voltage is applied first to terminal 6 only. This causes drive 22 via the normally closed contacts 40 and 20 to run towards "closed position" until the air throttle is completely closed and the limit switch 21 opens shutting off drive 22 (shown as Z in FIG. 2).

Now, if at the moment $t_1$ the first regulator 7 is closed and if the safety switch 8 is closed, a voltage is applied to the main terminal 10 and the auxiliary terminal 11. The single-wire relay 24 is excited via the "single-wire relay" changeover switch 41 in its normally closed position in contact with main input terminal 10. Single-wire relay 24 activates "drive direction" changeover switch 25 and causes drive 22 to drive towards "open position" via conductor 45. At the same time, single-wire relay 24 interrupts the connection between terminal 6 and drive 22 by means of switch 40.

Once the air throttle has reached position M for the first burner step, the "drive towards closed position" circuit breaker 29 which is connected to drive 22 closes as a precautionary measure.

At the moment $t_2$ the air throttle has reached a position 47 between the position for the first burner step M and the position for the second burner step A. The auxiliary switch 28 is then activated by drive 22 and closes the connection between the main terminal 16 and the output terminal 13 as well as energizing the no-voltage relay 19.

At this point, the blower 17 is started up via output terminal 13 and a voltage is applied to the time switch 12. The blower 17 thereupon starts pre-ventilation.

The excited no-voltage relay 19 then switches the "single-wire relay" changeover switch 41 over to terminal 15 to which no voltage is applied at first and therefore allows the single-wire relay 24 to fall off. This causes the "drive direction" changeover switch 25 to return to its normally "closed" drive position. The "drive towards closed position" changeover switch 20 is switched over by the no-voltage relay 19 in the direction of the "drive towards closed position" circuit breaker 29, the latter, as stated earlier, having been switched on previously as a precautionary measure. Drive 22 now runs towards "closed" until the "drive towards closed position" circuit breaker 29 switches off at point 48 when the air throttle has reached the position for the first burner step M. The air throttle control 2 is now ready for the operation of the first burner step.

In the first burner step, a relatively small amount of fuel is fed to the burner through the first fuel valve 18.

As the auxiliary switch 28 closes and a voltage is applied to the output terminal 13, and after a first delay period of the time switch 12, the burner valve 18 is activated (via output terminal 13, time switch 12, and terminal 16) for the first burner step and the first burner step is under way. The "second burner valve" switch 27 receives voltage but does not yet switch on.

After a second delay period of the time switch 12, a voltage is also applied to the second regulator 14, but it is not switched on at first so that the regulator terminal 15 is still without voltage.

When the second regulator 14 comes into action at point 49 of FIG. 2, the regulator terminal 15 receives voltage. The single-wire relay 24 is excited and switches the "drive direction" changeover switch 25 over to its "drive towards open position". Drive 22 runs towards "open position". At point 50, the "second burner valve" switch 27, which is activated by drive 22, is closed and the second burner valve 35 now opens. At point 51, the air throttle reaches the position for the second burner step A. The "open position" limit switch 26 switches off drive 22. The blower burner now runs in the second burner step.

Thus, in the second burner step, a second fuel valve 35 is added via the switch 27 so that a greater amount of fuel (the sum of the fuel flowing though the two valves 18, 35) flows to the burner.

When regulator 14 is switched off, the single-wire relay 24 falls off once more and causes the "drive direction" changeover switch 25 to switch to its "drive towards closed position". The "second burner valve" switch 27 then switches off the second burner valve 35 at a point corresponding to point 50 until the "drive towards closed position" circuit breaker 29 switches off drive 22 and thus stops the air throttle in the position for the first burner step M. Operation continues in the first burner step. Any number of changeovers can be effected between the first and the second burner steps and vice versa.

To switch off the air throttle control 2 completely, the first regulator 7 or the safety switch 8 is switched off. This deprives the main input terminal 10 of current 9. The no-voltage relay 19 falls off and the air throttle is brought towards the "closed" position by drive 22 which still receives current from terminal 6 via the closed contacts of the switches 40, 20 and 21. Drive 22 continues to operate until the "closed" limit switch 21 opens again and switches off drive 22 when the air throttle is completely closed.

Figure 3:
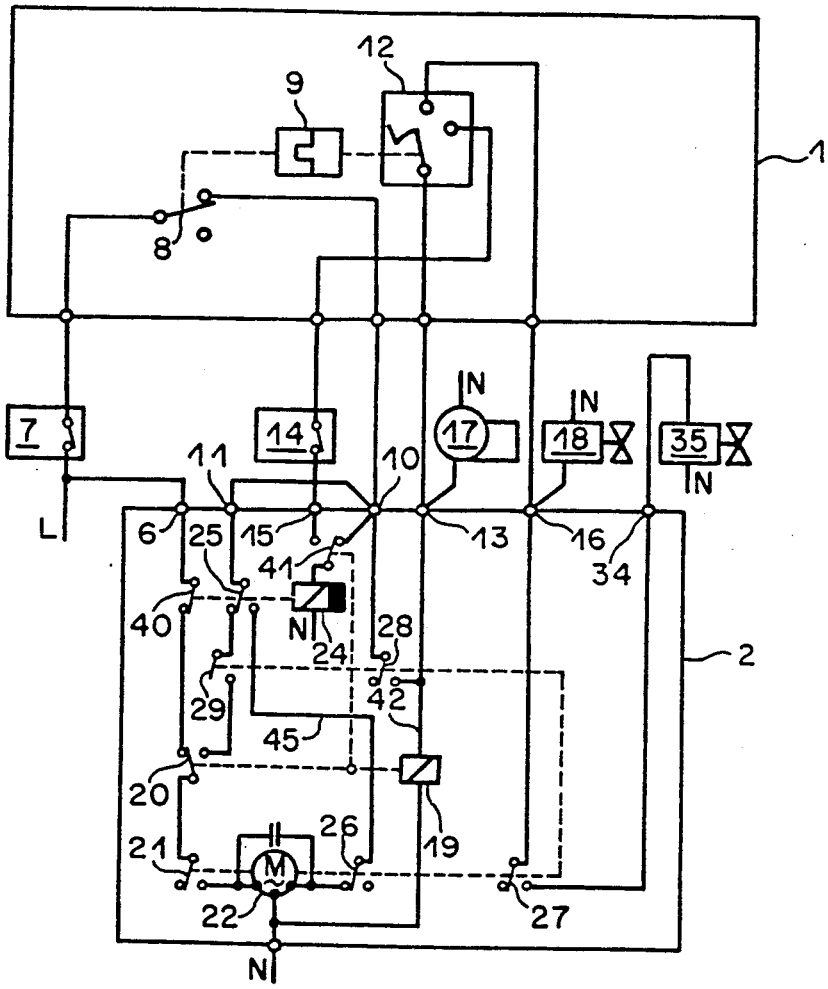
FIG. 3 shows a circuit diagram of an air throttle control according to the instant invention.
Figure 4:
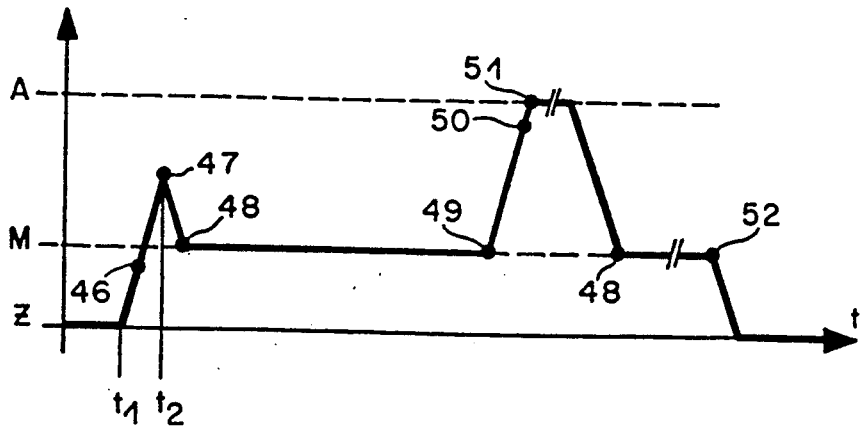
FIG. 4 shows a graph associated with FIG. 3.

In the air throttle control 2 according to the present invention as shown in FIG. 3, the no voltage relay 19 is used without the latch 43, the single-wire relay 24 operates with a falling off delay and the auxiliary switch 28 is activated as early as the point 46 (FIG. 4), before the air throttle, in its movement towards "open position", reaches the position for the first burner step M. With respect to all its other elements and with respect to the functions of same, it is substantially identical to the air throttle control according to GB 2 150 320 B. For this reason, only that which is different is described hereinafter with respect to the graph shown in FIG. 4.

The auxiliary switch 28 is activated as early as the point 46 before the air throttle has reached the position for the first burner step M on its way to "open position". The no-voltage relay 19 is thereby excited at point 46 rather than at point 47. In order to maintain it in a state of excitation up to the moment at which the air throttle control 2 is switched off by the first regulator 7 or the safety switch 8, no latch 43 (FIG. 1) is required because the air throttle never assumes a position below point 46 during operation of the burner. The no-voltage relay 19 is thus not switched off. The air throttle control 2 according to the invention operates therefore with a latch-free, no-voltage relay 19.

Due to its excitation, the no-voltage relay 19 switches the "single-wire relay" changeover switch 41 to the regulator terminal 15 which is as yet not under voltage and causes the single-wire relay 24 to be without current. However, the single-wire relay 24 of the present invention is a relay that falls off with a built-in delay so that it causes the "drive direction" changeover switch 25 to change over only following a period of delay. During the period of delay, the drive 22 continues to run towards "open position" and the "drive direction" changeover switch 25 changes over only when the air throttle has reached point 47 which is determined by the period of delay. At that moment, the "drive towards closed position" circuit breaker 29 has already been brought into such a position by the first exceeding of the position for the first burner step M by the air throttle drive, and the "drive to closed position" changeover switch 20 has already been brought into such a position by the excitation of the no-voltage relay 19 at point 46, that the flow of current is ensured via elements 25, 29, 20 and 21 towards the drive 22. Only when the "drive direction" changeover switch 25 changes over after the delay period built into single-wire relay 24 does drive 22 begin to run towards "closed position". When the position for the first burner step M is reached at point 48, the "drive towards closed position" circuit breaker 29 shuts off drive 22. Thus, the air throttle does not return below point 46, which would cause a falling off of no-voltage relay 19 and closing of the air throttle by drive 22 unless that is desired.

The transition to the operation of the second burner step and the switching off of the two burner steps occur in the same manner as explained in connection with FIGS. 1 and 2.

In this way an air throttle control 2 is created which can be built into a greater number of small drives of air throttles thanks to the omission of the bulky and expensive latch 43 for the no-voltage relay 19.

While the invention has been described by reference to specific embodiments, this was for purposes of illustration only and should not be construed to limit the spirit or scope of the invention.

We claim:

1. A control unit for a blower burner capable of operating in a first burner step with a lower level of fuel consumption and in a second burner step with a higher level of fuel consumption, said control unit comprising a drive for an air throttle capable of running in a first direction from closed to open and in a second direction from open to closed, said air throttle drive having a first operating position for the first burner step and a second operating position for the second burner step, switch means operable under control of said drive for being activated by said drive before said first burner step when said drive is running in said first direction and before said air throttle drive passes the first operating position for the first burner step, first, latch-free relay means for being excited upon activation of said switch means before said first burner step when said drive is running in said first direction and before said drive passes the first operating position for the first burner step, and second relay means operable under control of said first latch-free relay means for causing said drive to switch from said first direction to said second direction after a delay period following the excitation of said first latch-free relay means and for enabling said drive to continue operation in said first direction during said delay so that said drive passes said first operating position before said drive switches from said first direction to said second direction.

2. A control unit for a blower burner capable of operating in a first burner step with a lower level of fuel consumption and in a second burner step with a higher level of fuel consumption, said control unit comprising a drive for an air throttle capable of running in a first direction from closed to open and in a second direction from open to closed, said air throttle drive having a first operating position for the first burner step and a second operating position for the second burner step, switch means operable under control of said drive for being activated by said drive before said first burner step when said drive is running in said first direction from open to closed and before the air throttle drive passes the first operating position of the first burner step, first relay means for being excited upon activation of said switch, said first relay means being latch free, and second relay means operable under control of said first relay means and having a release delay for causing said drive to switch from said first direction to said second direction after a period of time substantially equal to said release delay following the excitation of said first relay, so that said drive continues operation in said first direction during said delay of said second relay and so that said drive passes said first operating position before said drive switches from said first direction to said second direction.

* * * * *